US005692652A

United States Patent [19]

Wise

[11] Patent Number: 5,692,652

[45] Date of Patent: Dec. 2, 1997

[54] SELF-CLOSING VALVE FOR BOTTLES

[76] Inventor: Hector G. Wise, P.O. Box 26713, Las Vegas, Nev. 89126

[21] Appl. No.: 781,100

[22] Filed: Jan. 8, 1997

Related U.S. Application Data

[63] Continuation of Ser. No. 324,871, Oct. 18, 1994, abandoned.

[51] Int. Cl.[6] ..... B67D 3/00

[52] U.S. Cl. ..... 222/518

[58] Field of Search ..... 222/501, 507, 222/510, 518

[56] References Cited

U.S. PATENT DOCUMENTS

| | | | |
|---|---|---|---|
| 16,553 | 1/1857 | Pomeroy | 222/518 X |
| D. 282,050 | 1/1986 | Beaver et al. . | |
| D. 282,252 | 1/1986 | Yamaguchi et al. . | |
| D. 294,802 | 3/1988 | Beaver . | |
| 780,472 | 1/1905 | Bardsley et al. | 222/518 X |
| 819,217 | 5/1906 | Harless | 222/518 X |
| 1,046,515 | 12/1912 | Wakefield | 222/518 X |
| 2,857,080 | 10/1958 | Elias | 222/507 X |
| 3,074,444 | 1/1963 | Hawksford | 222/501 X |
| 3,154,222 | 10/1964 | Heckman | 222/518 X |
| 3,241,727 | 3/1966 | Heckman | 222/518 X |
| 3,731,851 | 5/1973 | Rauh | 222/518 X |
| 4,936,446 | 6/1990 | Lataix | 206/221 |
| 5,000,354 | 3/1991 | Lee et al. | 222/518 X |
| 5,000,360 | 3/1991 | Lown et al. . | |
| 5,020,702 | 6/1991 | James . | |
| 5,123,570 | 6/1992 | Dubow et al. | 222/510 X |

*Primary Examiner*—Andres Kashnikow
*Assistant Examiner*—Kenneth Bomberg
*Attorney, Agent, or Firm*—Knobbe, Martens, Olson & Bear, LLP

[57] ABSTRACT

A self-closing valve for use with a bottle which includes a body having a neck with an opening therein at one end, and a moveable base at the other, is provided. In general, the valve comprises a stopper for selective location in the opening of the neck of the bottle, and an elongate actuating arm for moving the stopper. One end of the elongate arm is connected to the base of the bottle, while the stopper is located at the opposite end. Means are provided for allowing the base of the bottle to move with respect to the body. Pressure on the base of the bottle thus causes upward movement of the elongate arm, which movement causes the stopper to be pressed outwardly from the opening in the neck of the bottle, thus allowing fluid to flow from the bottle. Biasing means cause the base of the bottle to return to its natural state upon removal of the pressure, which simultaneously causes the stopper to be retracted into the neck of the bottle, stopping fluid flow.

12 Claims, 2 Drawing Sheets

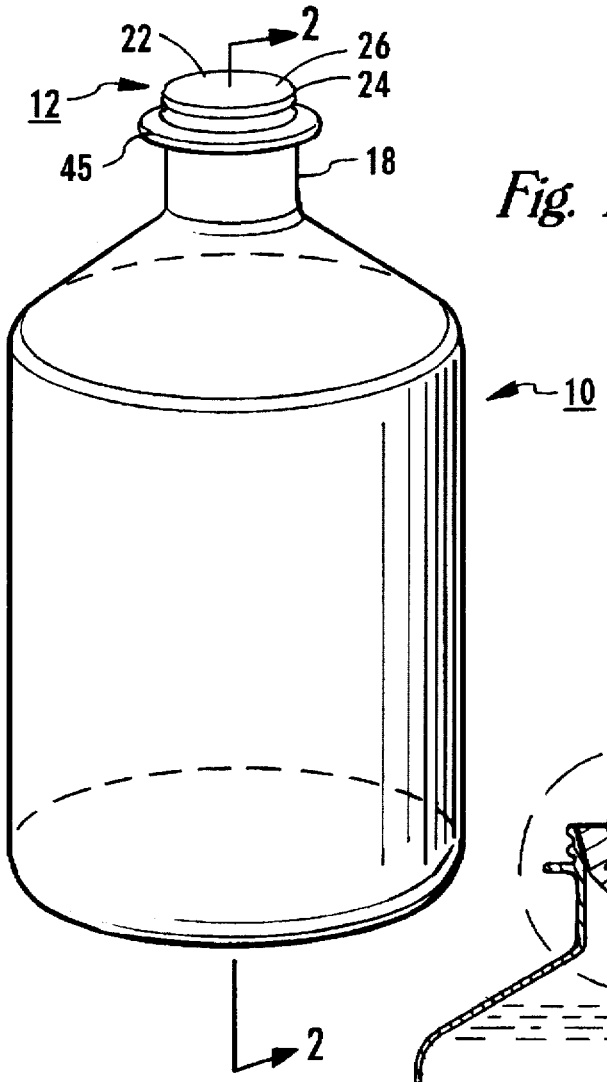
Fig. 1
Fig. 2
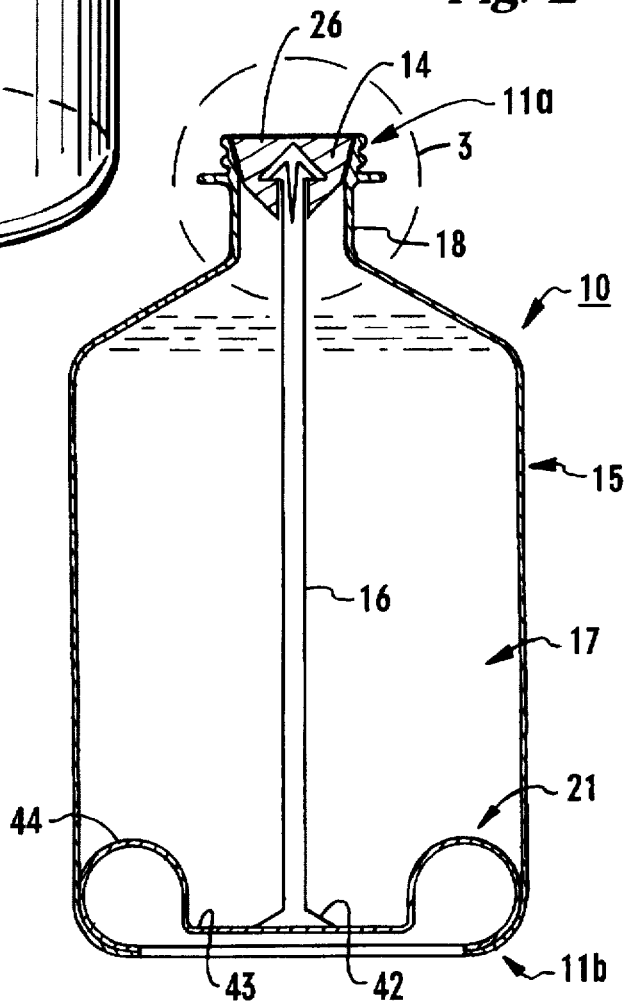
Fig. 3
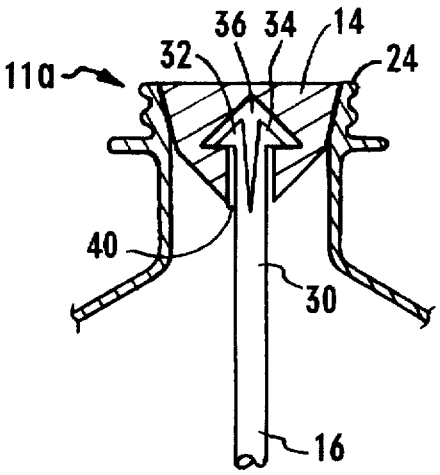

Fig. 4
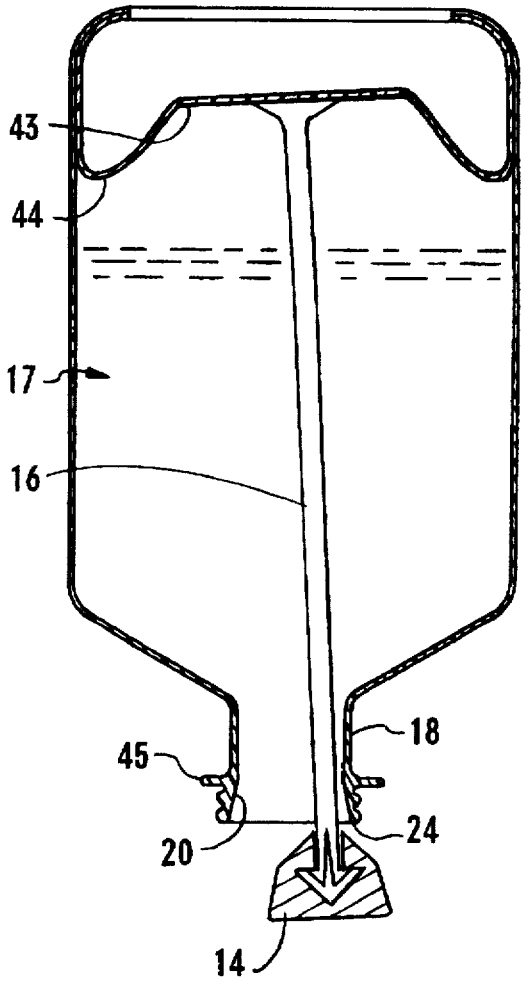
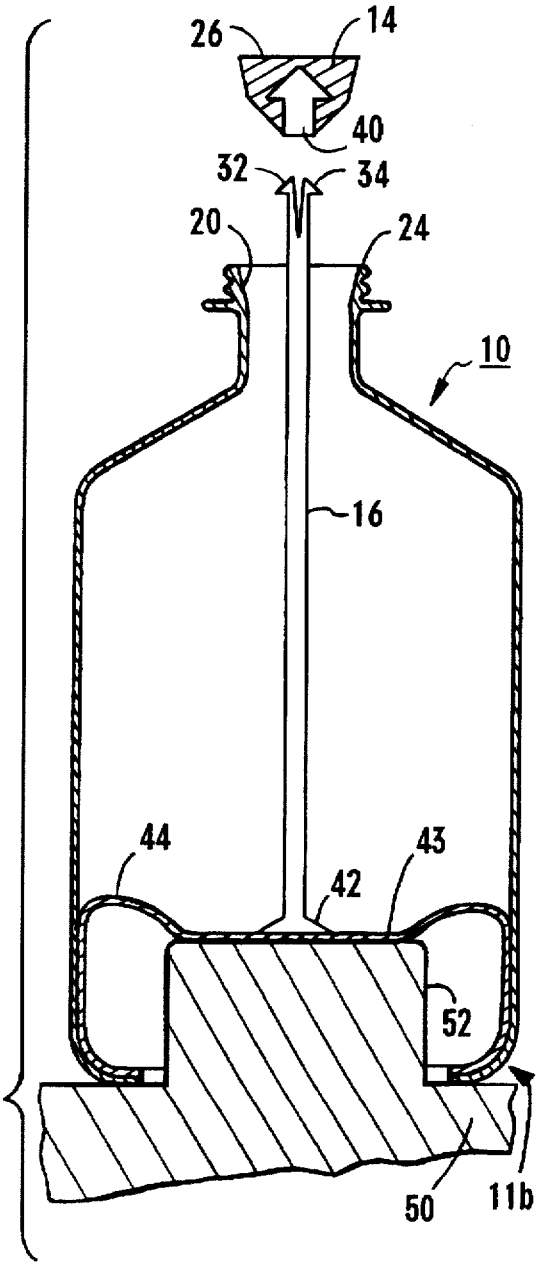
Fig. 5
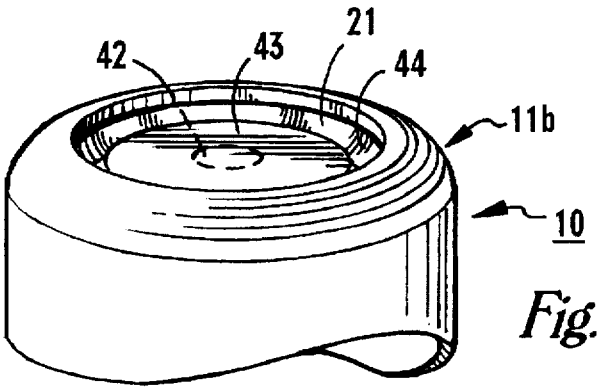
Fig. 6

SELF-CLOSING VALVE FOR BOTTLES

"This application is a continuation of U.S. patent application Ser. No. 08/324,871, filed Oct. 18, 1994," now abandoned.

BACKGROUND

1. Field of Invention

The present invention relates to a self-closing valve for use with a bottle. The valve is preferably built permanently inside a one quart motor oil bottle, and controls the outflow of motor oil from a bottle, so that oil only flows when desired.

2. Background of the Invention

Motor oil is readily available in convenient resealable one quart plastic bottles in auto supply houses and supermarkets. These bottles are used by consumers to refill engine oil or for complete oil changes in their motor vehicles or boats. One quart oil bottles were a great improvement over their predecessor, the one quart oil can. The oil can had a metal lid that needed to be punctured to release its contents. This led to difficulties in pouring the oil, inevitably causing the consumer to spill a lot of oil. In addition, the oil can could not be resealed easily, resulting in the contamination and discard of otherwise good oil.

While the one quart oil bottle was a noteworthy improvement over the can, even these bottles promote oil spillage. In particular, after the contents of the bottle have been drained into the fillerhole of an engine, oil from the bottle will keep dripping as the bottle is being extracted from the fillerhole.

Several products have been commercially introduced to overcome the persistent difficulty of pouring oil from one quart bottles without spillage. One such product is the funnel. While the funnel more accurately directs oil into an engine fillerhole, it also drips oil once withdrawn. In addition, a funnel can be easily misplaced, or overfilled, leading the consumer to spill large quantities of oil onto the engine block. Others have attempted to produce products with the specific aim of providing a means for pouring oil from a one quart bottle into the fillerhole without spillage.

U.S. Pat. No. 5,000,360 to Lown et al. (1989) describes a curved plastic spout that is screwed onto the open end of a one quart oil bottle. The Lown et al. spout has a valve within the spout which can be opened or closed by turning a portion of the spout in either direction.

While the Lown device can be used to turn on and off the flow of oil out of the bottle, hardly any oil runs out when the spout is set in the open position. A bottle equipped with the Lownet al. spout has to be continuously squeezed so that oil flows rapidly into the engine. In addition, the spout keeps dripping oil after the valve has been shut off since the valve is not located at the extreme end of the spout. Similarly, oil will spill when transferred from one bottle to another, or when being stored. Also, the Lown et al. spout can easily be misplaced since it is not a permanent part of the bottle, and is expensive to manufacture.

Two other devices falling into the same category are called "POURS MORE" and "EASY POUR". These devices are approximately 9" long plastic pipes having several ridges in order to make them flexible. They have accommodations at one end to enable them to be screwed onto an uncapped one quart oil bottle. U.S. Pat. No. 5,020,702 describes a detachable cap in addition to the flexible neck. Although these devices are improvements on the bottle itself, they still have a number of disadvantages. Most importantly, these devices still spill oil when being removed from the fillerhole, retain a large amount of oil inside their necks, and will spill oil when transferred from one bottle to another. In addition, they can easily be misplaced since they are not a permanent part of the bottle.

Another related device is described in Design Patent D 294 802 to Kendall Oil. The Kendall design patent discloses a conventional rectangular one quart oil bottle having a longer ridged neck. Yet another device is Quaker States' round one quart oil bottle with a vented neck. This product is described in Design Patents D 282,050 and D 282,252 (1983). The Quaker device still has the disadvantage that it spills oil during the process of pouring oil into the fillerhole. In addition, the Quaker device keeps dripping oil after being withdrawn from the fillerhole.

SUMMARY OF THE INVENTION

The present invention is a self-closing valve which is permanently mounted inside of a bottle, most preferably within a one quart plastic oil bottle. The self-closing valve comprises a stopper that is internally linked to the base of the oil bottle. When a customer presses inwardly on the base of the bottle, the stopper is lifted up and out of the bottle mouth, thereby allowing oil to be released. Linkage between the stopper and the base of the bottle is preferably provided by an arm that traverses the inside of the bottle. Means for allowing the base to move with respect to the body of the bottle are provided such that inward pressure from a customer moves the base, and thus the plastic arm, a large enough distance to open the stopper and release a flow of oil.

The means connecting the base to the bottle also provides a biasing function, that once pressure is released from the base of the bottle by the customer, the inner plastic arm is retracted, reseating the stopper in the bottle mouth. In the preferred form, this means comprises a biased coil or other member connecting the base to a body portion of the bottle. The self-closing valve thus comprises only two basic plastic parts: the stopper and the arm. Thus, the present invention can be produced in conjunction with the bottle at a low cost.

A unique aspect of this invention is that the self-closing valve is permanently mounted inside of the bottle. The integrated valve is therefore to be thrown away with the bottle. This provides an advantage over previous devices for controlling spilling in that the present device may not be lost or incorrectly attached.

The valve of the present invention provides a means for controlling the amount of oil poured out of the bottle. The valve can regulate pouring either the entire contents, or a specific amount of oil out of a one quart bottle and into the fillerhole of an engine. When using the self-closing valve of the present invention, virtually no oil is ever spilled.

The self-closing valve of the present invention also provides a means for pouring oil from a one quart oil bottle into the fillerhole of an engine wherein no device has to be attached, detached, or transferred to the bottle. The present device thus eliminates the need to transfer spouts between bottles, which transfer invariably leads to oil being spilled.

Most importantly, the self-closing valve prevents spillage even when the cap of the bottle is off. This feature means that an accidentally dropped bottle will not cause an oil spill. This feature advantageously works to aid in ecological preservation of the earth, including lakes, streams and oceans. This is because oil will not be spilled by the user, as often occurs presently. It is presently commonplace for oil to be directly spilled onto the ground or into bodies of water, or onto the engine, where it later burns or drips onto roadways. Bottles including valves of the present invention, however, which are thrown away and yet still contain oil, will not release the oil into the ground or water system, as these bottles remain closed after use.

Further objects, features, and advantages of the present invention will become apparent from the detailed description of the drawings which follows, when considered with the attached figures.

BRIEF DESCRIPTION OF THE DRAWINGS

FIG. 1 is a perspective view of the present invention, illustrating a bottle having a neck and a body, and illustrating a stopper located in an opening in the neck;

FIG. 2 is a cross-sectional view of the invention as illustrated in FIG. 1, taken along Line 2—2 thereof, illustrating a valve of the present invention, comprising a stopper and connecting arm;

FIG. 3 is a partial enlarged cross-sectional view of the invention as illustrated in FIG. 2, taken along Line 3—3 thereof;

FIG. 4 is a cross-sectional view of the invention illustrated in FIG. 1, illustrating the invention when in use with the valve in an open position.

FIG. 5 is a view of the present invention during assembly, illustrating the bottle located on an assembly station with the stopper being connected to the connecting arm; and FIG. 6 is a perspective bottom view of the present invention.

DETAILED DESCRIPTION OF THE INVENTION

The present invention comprises an oil bottle 10 having a self-closing valve 12 as illustrated in FIG. 1. The self-closing valve 12 of the present invention preferably comprises two main parts. As shown in more detail in the cross-sectional view of FIG. 2, the first part of the self-closing valve 12 is a stopper 14, and the second part is a connecting arm 16, which is preferably a permanent part of the bottle 10 as the same is preferably made by injection molding.

The bottle 10 is similar to a standard oil container. In particular, the bottle 10 has a first end 11*a*, and a second end 11*b*, and includes a main body 15 defining a fluid reservoir 17. A neck 18 is located at the first end 11*a* of the body 15, extending upwardly from the main portion of the body 15. The neck 18 has an opening therein to permit fluid to be added and removed from the reservoir 17. A flange 45 extends outwardly from the neck 18 near the first end 11*a* of the bottle 10. The flange 45 is preferably sized such that it will not pass through a standard oil fillerhole on an engine. Further, the flange 45 is located near enough to the first end 11*a* of the bottle 10 that when the stopper 14 is extended to allow fluid discharge (as described in more detail below) the stopper 14 does not contact any internal engine parts.

Preferably, the body 15 is circular in cross-section, although it is possible for the body 15 to be square or rectangular in cross-section.

As can be seen, the body 15 of the bottle 10 mainly comprises a tubular wall, and has a base 43 opposite the neck 18 which acts to close the end of the body 15. The base 43 is preferably circular in shape when the body 15 has a circular cross-section.

Preferably, means 21 are provided for moving the base 43 (and the stopper 14, as described below) with respect to the body 15. In the preferred form, this means 21 comprises a flexible, biased coil 44, which is preferably a permanent part of the bottle 10, as the bottle 10 and coil 44 are preferably made by an injection molding process. The coil 44 preferably extends circumferentially around the base 43 and connects it to the body 15. This coil 44 is preferably a section of biased material, which causes the base 43 to be recessed slightly from the second end 11b of the body 15. As can be appreciated, the means 21 may comprise any of a number of mechanisms or structures. For example, the means 21 could comprise an accordion-like inner wall connecting the base to the body.

Further, the bottle 10 includes means for biasing the stopper 14 into the opening in the neck 18. In the preferred form, the means for biasing is the same as the means for moving the biased coil 44. It is noted that the coil 44 resists movement of the base 43 in either direction, and thus, while pressure will cause deflection of the base 43 with respect to the body 15, the coil 44 causes the base 43 to return to its original position when the pressure is removed. Of course, the means for biasing need not be the same as the means for moving 21, as is apparent to one skilled in the art.

Preferably, the entire body 15, including the base 43, coil 44, and arm 16 are formed as a single piece of material. In particular, it is desired that the body 15 be made of plastic in an injection mold process.

The stopper 14, which is preferably manufactured of plastic, although other suitable materials such as rubber may be used, is designed to block the outflow of oil through the neck 18 of the bottle 10. The stopper 14 substantially conforms to a concave inner surface 20 of the neck 18, so that when engaged, the stopper 14 provides a liquid-tight seal with an inner surface 20 of the bottle 10 (see FIG. 4). One can appreciate that when the stopper 14 is engaged with the inner surface 20 at the neck 18, a uniform upper surface 22 is presented at the first end 11*a* of the bottle 10. The uniform surface 22 is provided by a combination of a top lip 24 of the neck 18, and a top portion 26 of the stopper 14. As shown in both FIGS. 1 and 2, the uniform surface 22 allows a cap (not shown) to be screwed onto the bottle 10 without impediment.

The stopper 14 is preferably connected to the upper region or top end of the connecting arm 16 by a split triangular tongue 30 as shown in more detail in FIG. 3. The tongue 30 has a left triangular head 32 and a right triangular head 34. The left and right heads 32, 34 are designed to mate with, and lock into, a triangular hollow receptacle 36 in the interior of the stopper 14. The split triangular tongue 30 provides a locking means for permanently affixing the connecting arm 16 to the stopper 14.

Directly below the hollow receptacle 36 is a guide channel 40 that provides a passage for the split triangular tongue 30 to the receptacle 36. During insertion of the split triangular tongue 30 through the guide channel 40, the right and left heads 32 and 34 compress towards each other until the triangular tongue 30 reaches the receptacle 36. Once inside the receptacle 36, the split triangular tongue 30 uncompresses, locking in place. In this manner, the connecting arm 16 is permanently affixed to the stopper 14. Of course, other means for attaching the stopper 14 to the arm 16, as are well known to those skilled in the art may be used.

On a second or bottom end of the connecting arm 16, located opposite the split triangular tongue 30, is an attachment point 42. The attachment point 42 is attached to the base 43 of the bottle 10. One of ordinary skill in the art will appreciate that many methods are available for attaching the connecting arm 16 to the base 43, however, it is preferred that the arm 16 be formed with, and as a part of the bottle 10. One can also appreciate that in accordance with the present construction, upward pressure on the base 43 will force the connecting arm 16 upward, leading to upward movement of the stopper 14.

As can be seen, the means for moving 21 the base 43, including the coil 44 provides a means whereby inward pressure applied by a user to the base 43 of the bottle 10 moves the base 43, and thus the arm 16 and stopper 14, a sufficient distance out of the neck 18 to allow the flow of oil.

The coil 44, being biased, also tends to retract the stopper 14 back into the neck 18 after pressure on the base 43 including the inner wall 44, is released. Most importantly, this biasing function causes the stopper 14 to remain retracted into the neck 18 even when a cap (not shown) is placed over the neck 18.

The preferred method of assembling the device will now be described in conjunction with FIG. 5. As described above, preferably the bottle 10, including the base 43 and arm 16, are formed of plastic in an injection molding process. The stopper 14 is preferably also made of plastic in an injection molding process, but is made as a separate article of manufacture.

Once the bottle 10 and stopper 14 have been manufactured, the bottle 10 is preferably placed on an assembly stand 50. This stand 50 is designed such that upon downward pressure on the bottle 10, a central section 52 of the stand 50 engages the base 43, causing the arm 16 to move upwardly out of the neck 18 of the bottle 10. Once in this position, oil or another fluid may be easily introduced into the container, and then the stopper 14 may easily be fitted over the tongue 30 of the arm 16, as described above.

The bottle 10 is then removed from the stand 50, at which time the stopper 14 is retracted, closing the neck 18. A cap (not shown) may then be threaded onto the first end 11*a* of the bottle 10.

Once again, however, when the cap is removed, the stopper 14 remains in the neck 18, preventing fluid from flowing from the bottle 10. Only upon application of pressure on the base 43 will the base 43, and thus the arm 16 and stopper 14, move to open the neck 18. At that time, oil or other fluid in the reservoir 17 of the bottle may flow freely out. Thus, in use, a bottle 10 may be placed upside-down for positioning in an oil-filler hole, and no oil will flow unless pressure is being applied to the base 43.

Oil will immediately stop flowing when downward pressure ceases because of resetting of the stopper 16. As the bottle is lifted out of the fillerhole, oil dripping is practically reduced to zero because the valve seat is located at the extreme top part of the neck. This eliminates any oil spills onto the valve cover, the motor or ground, or into any river, lake or ocean.

As the present invention relates to a modification of the conventional one quart oil bottle, the bottle 10 should be made so that even with the self-closing valve mechanism 12, it still holds one quart of oil. In the instant case, as long as the resiliency of the coil 44 is not so great as to cause the base 43 to be located far from the second end 11*b* of the bottle 10, no size modification to a standard oil bottle 10 need be made.

Further, while not necessary, it is possible to make the neck 18 slightly wider than normal so that the oil will flow more rapidly out of the bottle once the self-closing valve 12 is released. Of course, it will be appreciated that the neck 18 must be small enough in diameter to fit inside an engine fillerhole.

Accordingly, the unique bottle of the present invention provides a simple and economic device for pouring oil into the engine of an automobile or boat with ease and without spillage. The present invention also provides a combination of bottle, and self-closing valve, where nothing needs to be attached, detached or stored. This is a great convenience advantage over the other spouts on the market today. The bottle of the present invention also makes an uncapped oil bottle leak-proof when it is accidentally dropped or stored laying on its side. Further, once the bottle is used and thrown away, if the bottle is exposed to high temperatures, the bottle will be even more permanently sealed, thus preventing leakage of any residual liquid in the bottle. The present invention is thus extremely useful in protecting the environment.

Although the preferred embodiment of this invention is a one quart oil bottle with a self-closing valve, one of ordinary skill in the art could adapt the same self-closing valve mechanism to other bottles. For instance, a one quart transmission fluid bottle could be manufactured with the self-closing valve of the present invention. This is especially advantageous, since transmission fluid is generally added in only fractions of a quart. Further, it is possible to adapt the same valve system to bottles of different sizes.

It will be understood that the above described arrangement of apparatus and the methods therefrom are merely illustrative of applications of the principles of this invention and many other embodiments and modifications may be made without departing from the spirit and scope of the invention as defined in the claims.

I claim:

1. A self-closing container for storing liquids comprising:

a bottle having a cylindrical body with a neck at a first end and an opposite second end, said second end having an annular, rigid skirt adapted to support the bottle in an upstanding position, a toroidal coil extending from said body proximate said skirt to a base, said base positioned within the bottle and recessed upwardly in said body from said skirt and extendable therein against a bias force generated by said coil, said base, coil and body defining a reservoir, said neck having an opening therein to said reservoir;

a stopper adapted to be received in the opening to close the opening in said neck; and an arm positioned within the reservoir of said bottle and coupled between the base and stopper, said arm movable between a first position in which said bias of said coil pulls said arm downwardly and said stopper into said neck, whereby flow through the opening therein from said reservoir is prevented, a second position in which application of force against the base and against said bias of said coil causes said base, and thus said arm, to move upwardly, dislodging said stopper from the opening for dispensing liquid from said reservoir.

2. The container in accordance with claim 1, wherein said base is a generally disc-shaped element.

3. The container in accordance with claim 1, wherein said stopper is tapered.

4. The container in accordance with claim 1, wherein said stopper includes a stepped, hollow receptacle defining therein an annular shoulder and the arm has a split tongue defining right and left heads, said tongue adapted to be inserted into the receptacle whereby said heads engage the shoulder to couple the stopper to the arm.

5. The container in accordance with claim 1, wherein said body is defined by an outer wall, said skirt defined by an inwardly extending section of said wall.

6. The container in accordance with claim 5, wherein said wall has an inner surface and an outer surface, and said coil is connected to said inner surface of said wall.

7. The container in accordance with claim 6, wherein said coil has a first edge connected to said wall and a second edge connected to said base, and wherein said coil extends generally upwardly from said wall into said body towards said first end before curving back to said base, when said coil is in its unbiased position.

8. The container in accordance with claim 1, wherein said body has a recessed section therein at said second end in which said base is positioned, said recessed section defined by said skirt.

9. A self-closing container for storing material therein comprising:

a body with a first end and an opposite second end, said second end having a rigid skirt adapted to support the container in an upstanding position, a toroidal coil extending from said body proximate said skirt to a base, said base positioned within the body and recessed upwardly in said body from said skirt and extendable therein against a bias force generated by said coil, said base, coil and body defining a reservoir, said first end including a neck having an opening therein leading to said reservoir;

a stopper adapted to be received in the opening in said neck to prevent the flow of material therethrough from said reservoir; and an arm positioned within the reservoir of said container and coupled between the base and stopper, said arm movable between a first position in which said bias of said coil pulls said arm downwardly and said stopper into said opening in said neck, whereby flow therethrough is prevented, a second position in which application of force against the base and against said bias of said coil causes said base, and thus said arm, to move upwardly, dislodging said stopper from the opening for dispensing material therethrough from said reservoir.

10. The container in accordance with claim 9, wherein said body is generally cylindrical in shape.

11. The container in accordance with claim 9, wherein said base is generally circular in shape and said skirt is generally ring-shaped and defines an inner periphery, said base having a diameter smaller than the inner periphery.

12. The container in accordance with claim 9, wherein said coil has an outer edge connected to said skirt and an inner edge connected to said base and is generally "C"-shaped therebetween when a force is not applied to said base.

* * * * *